US008633789B2

(12) United States Patent
Schön

(10) Patent No.: US 8,633,789 B2
(45) Date of Patent: Jan. 21, 2014

(54) FORCE ARRANGEMENT FOR RADIO FREQUENCY FILTERS

(75) Inventor: Lennart Schön, Stockholm (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 461 days.

(21) Appl. No.: 12/993,570

(22) PCT Filed: May 21, 2008

(86) PCT No.: PCT/SE2008/050596

§ 371 (c)(1),
(2), (4) Date: Nov. 19, 2010

(87) PCT Pub. No.: WO2009/142560

PCT Pub. Date: Nov. 26, 2009

(65) Prior Publication Data

US 2011/0070860 A1 Mar. 24, 2011

(51) Int. Cl.
*H01P 7/06* (2006.01)
*H01P 1/30* (2006.01)

(52) U.S. Cl.
USPC ..... 333/229; 333/234

(58) Field of Classification Search
USPC ..... 333/229, 234
See application file for complete search history.

(56) References Cited

U.S. PATENT DOCUMENTS

| | | | | | |
|---|---|---|---|---|---|
| 3,986,150 | A | * | 10/1976 | Tanaka et al. | 333/200 |
| 4,057,772 | A | * | 11/1977 | Basil et al. | 333/229 |
| 4,639,699 | A | * | 1/1987 | Nishikawa et al. | 333/202 |
| 7,463,121 | B2 | * | 12/2008 | D'Ostilio | 333/223 |
| 2005/0030133 | A1 | * | 2/2005 | Rawnick et al. | 333/231 |

FOREIGN PATENT DOCUMENTS

| | | | |
|---|---|---|---|
| EP | 1187247 | A2 | 3/2002 |
| EP | 1505687 | A1 | 2/2005 |
| EP | 1755189 | A1 | 2/2007 |
| JP | 59066204 | A | 4/1984 |

* cited by examiner

*Primary Examiner* — Benny Lee
*Assistant Examiner* — Rakesh Patel
(74) *Attorney, Agent, or Firm* — Coats & Bennett, P.L.L.C.

(57) ABSTRACT

Embodiments relate to a force arrangement (50, 60) adapted to be mounted on a surface of a radio frequency filter that comprises a housing and a filter part extending along a first axis (A), the filter part being connected to a first side of the housing arranged perpendicular to the first axis (A) in a connection, the connection forming a contact seam between the filter part and the first side of the housing, wherein the force arrangement (50, 60) comprises a first spring part (56, 62) that is arranged, when mounted against the first side of the housing, to provide a first force in a first direction along the first axis (A) being opposite a direction of a stress force on the contact seam generated along the first axis (A) due to expansion of the housing (20) along the first axis (A) in the opposite direction of the provided force.

18 Claims, 4 Drawing Sheets

FORCE ARRANGEMENT FOR RADIO FREQUENCY FILTERS

TECHNICAL FIELD

The invention relates to a radio frequency filter. In particular, the invention relates to a force arrangement in a radio frequency filter.

BACKGROUND

Today, radio frequency filters are widely used in electronic devices in order to filter a certain frequency/-range from noise frequencies or the like. There exist a number of different types of radio frequency, RF, filters, and a certain type of radio frequency filters is a ceramic filter that may cover the frequency bands from 40 MHz to 5 GHz. These filters are therefore especially suitable for applications in devices of cellular communications systems or in WLAN equipment. However, ceramic filters may be used in all different kinds of electronics. By using ceramic radio frequency filters, the radio frequency filters may be shrunk substantially.

A radio frequency filter is assembled by arranging filter parts, such as pucks, discs, rods or the like, into a rigid housing or a sheet metal housing. In some radio frequency filters, a good electrical contact between the housing and the filter part is required for the radio frequency filter to work appropriately with a desired performance. A method of producing a good contact is done by soldering the elements of a radio frequency filter together.

One way of solving the demands for a good contact is also by creating parts with very good tolerance. This will however affect the price on the product.

As filters installed in electronic devices, such as base stations or the like, operate in temperature varying environments the housing of the radio frequency filters tends to move in relation to the filter part, due to, for example, different thermal expansion coefficients of the materials in the housing and the filter part, different shapes and dimensions or the like. In ceramic filters, the thermal expansion of the ceramic part differs substantially from the thermal expansion of the sheet metal. The filter elements expand and shrink differently resulting in that the elements tend to move back and forth relative each other wearing out the soldered seam keeping the elements in contact. This is due to the tensile and compressive forces that arise due to the willing to move relative another. The worn out soldered seam results in a poor electrical contact between the housing and the ceramic material reducing the performance of the radio frequency filter.

This may be solved by creating a force from an external screw. Adding a force from a screw to the assembly makes the assembly unnecessary big. A screw requires a thicker or more robust structure to support the forces generated from the screw. The use of a screw arrangement will result in a force that generates a contact between ceramic rod and the metal housing, but there will also be a reaction force on the perimeter between an end plate and the housing part that may create unwanted gaps.

SUMMARY

Embodiments provide arrangements to improve performance of a small sized radio frequency filter.

Some embodiments relate to a force arrangement adapted to be mounted on a surface of a radio frequency filter. The radio frequency filter comprises a housing and a filter part extending along a first axis, and being connected to a first side of the housing arranged perpendicular to the first axis in a connection. The connection forming a contact seam between the filter part and the first side of the housing, wherein the force arrangement comprises a first spring part that is arranged, when mounted against the first side of the housing, to provide a first force in a first direction along the first axis being opposite a direction of a stress force on the contact seam generated along the first axis due to expansion of the housing along the first axis in the opposite direction of the provided force.

Thereby, the performance is improved of the radio frequency filter.

Embodiments provide a filter arrangement with lasting performance, easier to tune and/or a compact design.

BRIEF DESCRIPTION OF THE DRAWINGS

Embodiments will now be described in more detail in relation to the enclosed drawings, in which.

DETAILED DESCRIPTION OF PREFERRED EMBODIMENTS

Embodiments of the present invention will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

In the illustrated embodiments ceramic radio frequency filters are shown. However, it should be understood that embodiments may be used in radio frequency filters comprising filter parts of other materials wherein movement between filter parts occur due to temperature variations.

Figure 1:
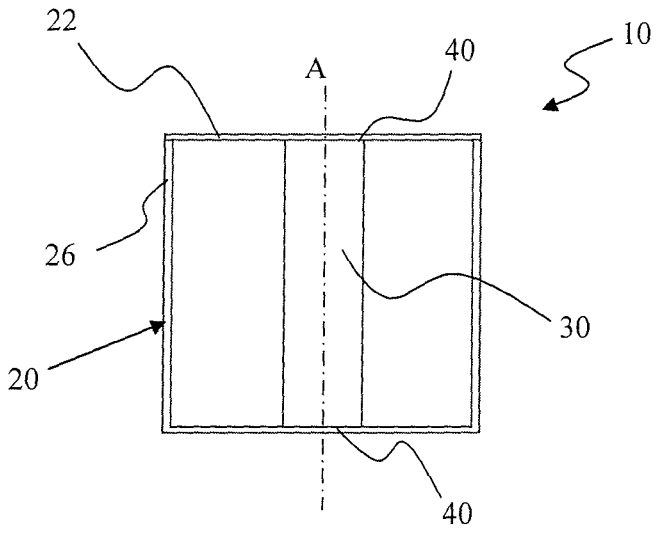
FIG. 1 shows a schematic cross section of a ceramic radio frequency filter.

In FIG. 1, a schematic cross sectional view of a radio frequency filter is shown. The radio frequency filter 10 comprises a conductive housing 20 and a filter part 30 extending along an axis A. The housing 20 may be in a conductive metal material, such as a silver plated aluminum sheet material to enhance its radio frequency properties. The filter part 30 may be in a different material, such as, ceramic or the like, but may also be in the same material as the housing.

In the illustrated example, the housing 20 has a square shape, but is not limited to this shape, and the filter part 30 is a rod, but may as well be in a different shape, such as, a disc, a puck or the like.

The illustrated housing 20 includes a U-shaped part 26 and a first end plate 22. The first end plate 22 extends over the U-shaped part 26 to seal off the interior and shield the interior from interferences. The material of the first end plate 22 may be of the same material as the U-shaped part 26 but is not limited to it. The ceramic rod 30 is mounted internally of the housing 20 and secured against the first end plate 22 and an opposite plate of the U-shaped part 26 facing the first end plate 22. The ceramic rod 30 should have good contact with the end plates as gaps result in a loss of performance of the radio frequency filter 10. In the illustrated example, end plate 22 and the U-shaped part 26 are soldered to the ceramic rod 30 resulting in soldered seams 40.

It should be understood that by filing the soldered end of the rod 30 the characteristics of the filter may be changed and this may be performed in order to tune the filter to a desired performance. It should also be noted that the filters may be fine tuned by other features, such as screws into the filter core or the like.

Figure 2:
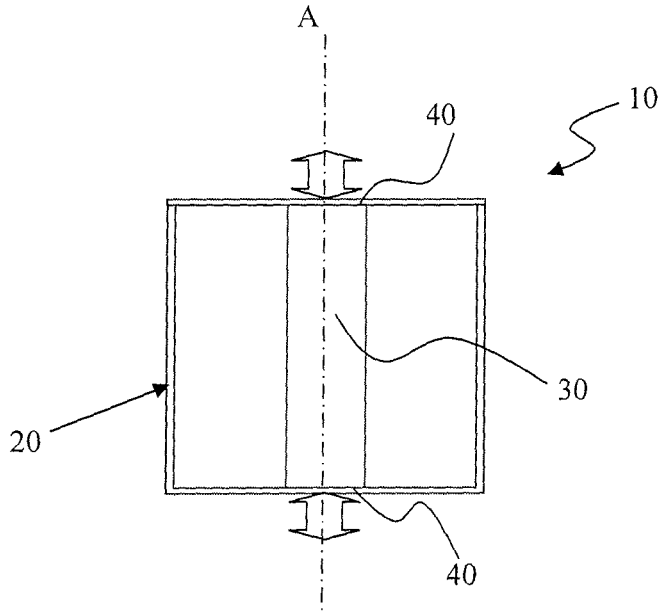
FIG. 2 shows a schematic cross section of a ceramic radio frequency filter with illustrated forces from the movement between housing and rod shown.

Referring to FIG. 2, the housing 20 has a first thermal expansion along a first axis A and the filter part 30 has a second thermal expansion along the same first axis A and temperature variations tend to generate tensile and compressive stress forces on a soldered seam 40 between the filter part and the housing, shown as arrows in FIG. 2. These stress forces may over time result in that gaps build up in the soldered seam 40 and gaps reduce the performance of the radio frequency filter 10.

It should here be noted that the forces may also arise in a radio frequency filter comprising a housing and filter parts being in the same material but wherein the elements tend to move relative another during temperature variations due to different dimensions and shapes.

Figure 3:
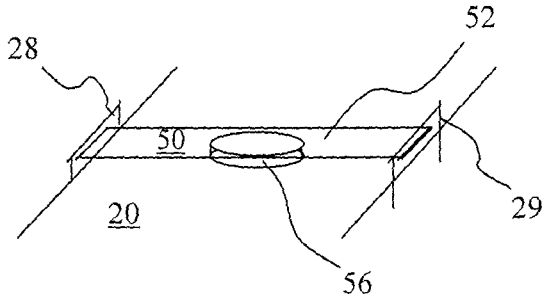
FIG. 3 shows a schematic overview of a force arrangement.

In FIG. 3, a schematic overview of a force arrangement 50 is disclosed. The force arrangement 50 is adapted to provide a force that is reactive to the forces exposed on the soldered seams from movement between the ceramic rod and the housing. In the illustrated example, the force arrangement 50 comprises a spring part 56 arranged to provide a force counteracting movement between the housing and the ceramic rod. The force arrangement further comprises a base part 52 securing the spring part 56 relative the housing by, for example, securing arrangements 28,29 in a part of the housing (as shown in FIG. 3), secured by a self locking arrangement (see FIGS. 4-5), secured in a structure accommodating the filter, and/or the like. The spring part may be biased against the housing 20.

Figure 4:
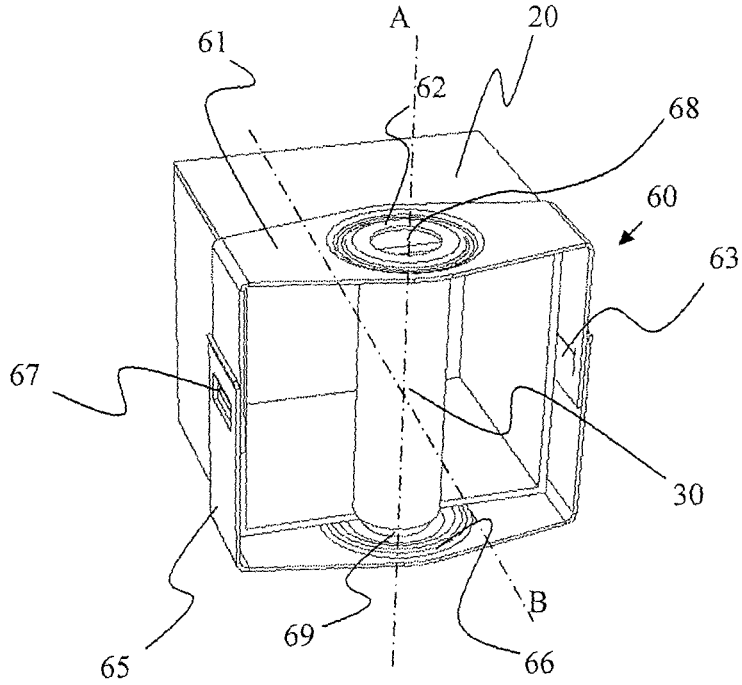
FIG. 4 shows a schematic overview of a force arrangement mounted on a radio frequency filter.

In FIG. 4, a schematic overview of an embodiment of a radio frequency filter comprising a force arrangement 60 is shown. The force arrangement 60 is adapted to keep a ceramic rod 30 extending along a first axis A against end plates of a housing 20 extending along a second axis B of the filter to obtain a good electrical contact between the ceramic rod 30 and the end plates. The force arrangement 60 comprises a first part 61 arranged with a first protruding spring part 62 and snap locking parts 63, and a second part 65 arranged with a second protruding spring part 66 and snap locking parts 67. The snap locking parts 63 and 67 may be arranged to be self locking when engaged with each other, thereby locking the first part 61 and the second part 65 to one another. When the locking parts are engaged, the protruding spring parts 62, 66 provide forces on the end plates counteracting movement along the first axis A between the housing relative the ceramic rod 30 due to temperature variations. Hence, the force arrangement 60 prevents gaps from arising and thereby a good electrical contact between the end plates and the ceramic rod is obtained, resulting in that the performance of the filter lasts longer.

The spring parts 61, 65 may further be arranged with cavities 68, 69, such as circular holes or the like. These cavities 68, 69 enable that the radio frequency filter may still be tuned even if the force arrangement 50 is mounted around the radio frequency filter as the soldered ends are accessible through the cavities 68, 69. The cavities 68, 69 may have any shape, circular, rectangular or the like.

Figure 5:
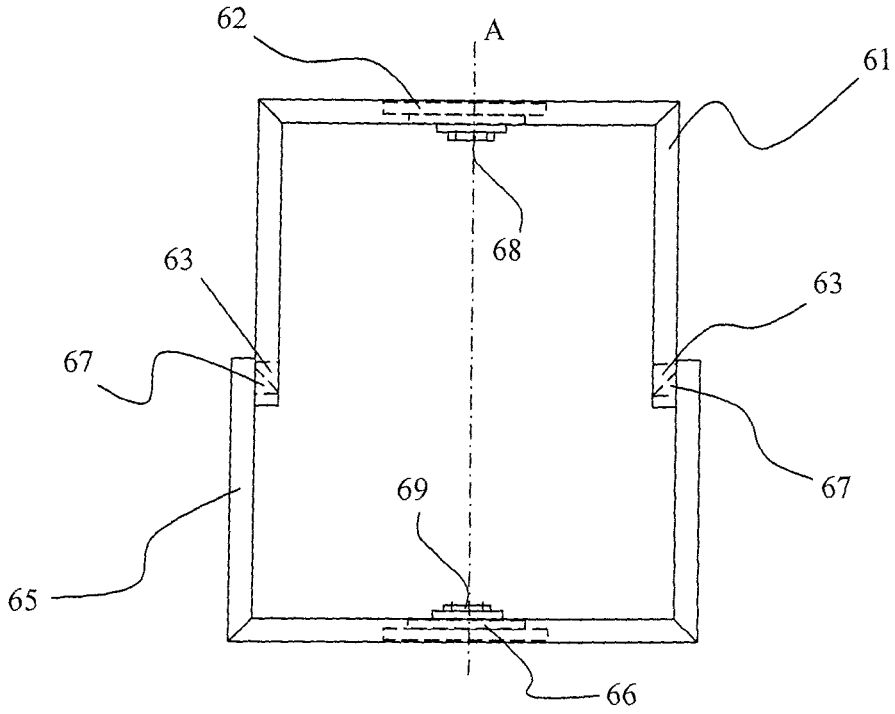
FIG. 5 shows a schematic front view of a force arrangement

In FIG. 5, a schematic front view of an assembled force arrangement 60 comprising spring parts 61, 65 is shown. A first spring part 61 is engaged and snap locked into a second spring part 65 by a snap lock arrangement comprising a protruding part 67 of the second spring part 65 gripping into an aperture 63 of the first spring part 61. In the illustrated embodiment, a force generating spring part 62, 66, such as a conically protruding part or the like, is arranged on both the first spring part 61 and the second spring part 65. When mounted on a ceramic radio frequency filter, these spring parts are arranged to provide a force, respectively, to the housing of the filter to keep the housing against a filter part mounted inside the housing such that a good electrical contact is established. The spring parts 61, 65 are further arranged with cavities 68, 69.

Figure 6:
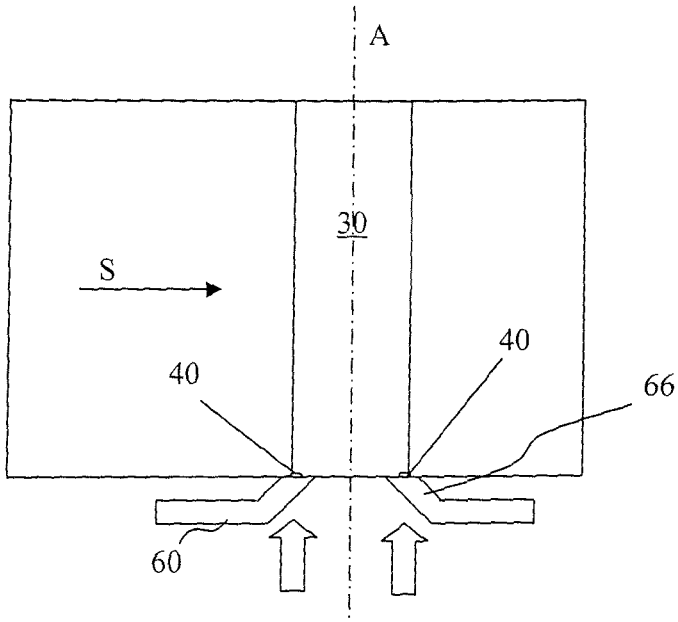
FIG. 6 shows a schematic cross sectional view of a ceramic radio frequency filter assembly.

In FIG. 6, a schematic overview of a radio frequency signal S traveling along the interior is disclosed. It is important that the signal S travels without unwanted interruptions and gaps in a soldered seam 40 between the housing and the ceramic rod 30. These disruptions will inflict on the signal resulting in a reduced performance. By providing a force, shown as arrows along a first axis A, from a protruding spring part 66 of a force arrangement 60 the stress forces on the soldered seam 40 are counteracted and the performance of the filter is improved.

Figure 7:
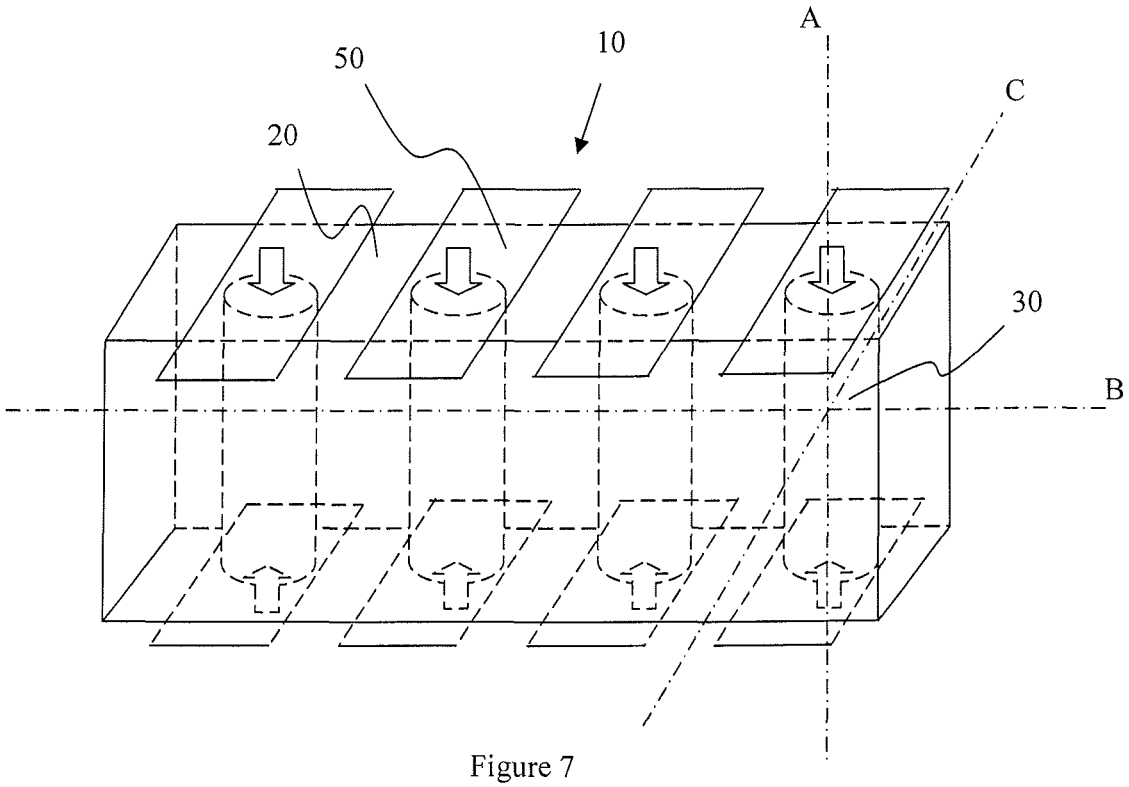
FIG. 7 shows a schematic overview of a radio frequency filter assembly.

In FIG. 7, a schematic overview of a radio frequency filter assembly is shown. The assembly comprises a housing 20 defining an inner cavity extending along an axis B, a plurality of filter parts 30, such as ceramic rods, extending longitudinally along an axis A being perpendicular to the axis B and multiple force arrangements 50. In the illustrated example the number of force arrangements 50 corresponds to the number of longitudinal parts 30. The force arrangements 50 provide forces along the axis A being parallel to the normal axis of the housing surface connected to the filter parts 30. A force arrangement comprises base parts extending along a third axis C arranged to enable the force arrangements to be secured relative the surface of the housing.

A force arrangement 50 may be configured as a sleeve comprising spring parts 56 generating forces toward one side of the filter housing corresponding to soldered seams between the filter parts 30 extending along a first axis A and the housing 20 extending along a second axis B. The force arrangement sleeve may further be arranged with means to provide forces corresponding to soldered seams between filter parts 30 and a second side of the housing 20, being any of the other sides of the housing.

In embodiments the force arrangement or force arrangements are applied where needed along the filter housing and may be self locking. The force arrangement may surround the radio frequency filter housing and counteract the forces between the inner surface of the housing and the top surface of the filter part. A filter arrangement may comprise thirty poles/rods and the force arrangement is suitable in size to be used in filter block arrangements.

Embodiments disclose a force arrangement that will not generate any unwanted force on the radio frequency filter structure since it is self locking with a counterpart detail, that is, a first and second spring part.

It should also be noted that the force arrangement may be mounted before the soldering providing a force to provide a good contact during the soldering.

By applying one or more springs that generates the desired force, a good electrical contact may be achieved during manufacturing, for example, during soldering of the filter elements, as well as during the operation of the assembly. In some embodiments, a force arrangement may be applied as a belt around the housing omitting the need for a supporting structure for securing the force arrangement.

It should be understood that the longitudinal parts may have a cross sectional shape being circular, rectangular, elliptic or the like.

The force arrangements are inexpensive and easy to assemble and may be assembled in a snap lock fashion or the like.

Referring back to FIG. 4, embodiments disclose a force arrangement 60 adapted to be mounted on a surface of a radio frequency filter that comprises a housing 20 and a filter part 30 extending along a first axis A, the filter part 30 being connected to a first side of the housing 20 arranged perpendicular to the first axis A in a connection. The connection forms a contact seam between the filter part 30 and the first side of the housing 20. The force arrangement 60 further comprises a first spring part 62 that is arranged, when mounted against the first side of the housing 20, to provide a first force in a first direction along the first axis A being opposite a direction of a stress force on the contact seam generated along the first axis A due to expansion of the housing 20 along the first axis A in the opposite direction of the provided force.

In embodiments, the force arrangement may comprise a first part 61 and a second part 65, the first part 61 comprises the first spring part 62 and a locking arrangement 63 and the second part 65 comprises a second locking arrangement 67, wherein the locking arrangements 62, 67 are adapted to lock the first part 61 to the second part 65 such that the parts 61, 65 are secured in position relative each other.

The second part 65 may be arranged with a second spring part 66 arranged, when mounted on the radio frequency filter, to provide a second force in a second direction toward the radio frequency filter to counteract expansion of the housing 20 in a second direction.

In some embodiments, the first part 61 and the second part 65 are arranged facing each other such that the first spring part 62 and the second spring part 66, when mounted on the radio frequency filter, are arranged to provide forces onto the housing toward each other along the axis A. The spring parts 62, 66 may be arranged perpendicular to each other or with an angle toward each other, depending on different embodiments of radio frequency filters.

The spring part/s 62, 66 may comprise a protruding conical shaped part.

The first part 61 may comprise a cavity 68 arranged in the first spring part 62 such that, when mounted on the radio frequency filter, the radio frequency filter is reachable for processing the radio frequency filter to an operational state.

The first spring 62 part may be arranged to provide the first force of a dimension set to prevent movement along the first axis A of the first side of the housing 20 in conductive metal relative the filter part 30 in ceramic material.

The force arrangement may be arranged to provide the first force of a dimension set to prevent forces to be exposed on the contact seam due to temperature variations resulting from a difference in thermal expansion along the first axis A between the housing 20 and the filter part 30.

Embodiments disclose a radio frequency filter assembly comprising a housing 20 defining an inner cavity, a filter part 30 extending along a first axis A and connected to a first side of the housing 20 being perpendicular to the first axis A in a connection, the connection forming a contact seam between the filter part 30 and the first side of the housing 20, wherein the assembly further comprises a force arrangement 60 according to the above.

The assembly may comprise a plurality of force arrangements 60.

In some embodiments, the housing has a first thermal expansion along the first axis A and the filter part 30 has a second thermal expansion along the first axis A being lower than the first thermal expansion.

The housing 20 may comprise a first material having a first thermal expansion coefficient and the filter part 30 may comprise a second material having a second thermal expansion coefficient lower than the first material.

The filter part 30 may comprise a rod extending along the first axis A.

In some embodiments, the housing 20 is defining a cavity that has a rectangular cross section and is extending in a second axis B being perpendicular to the first axis A.

The filter part 30 may comprise ceramic material.

The radio frequency filter housing 20 may comprise conductive metal sheet material.

The force arrangement 60 is arranged to counteract movement of the housing 20 relative the filter part 30 along the first axis A due to temperature variations.

The connection comprises a soldered seam.

Figure 8:
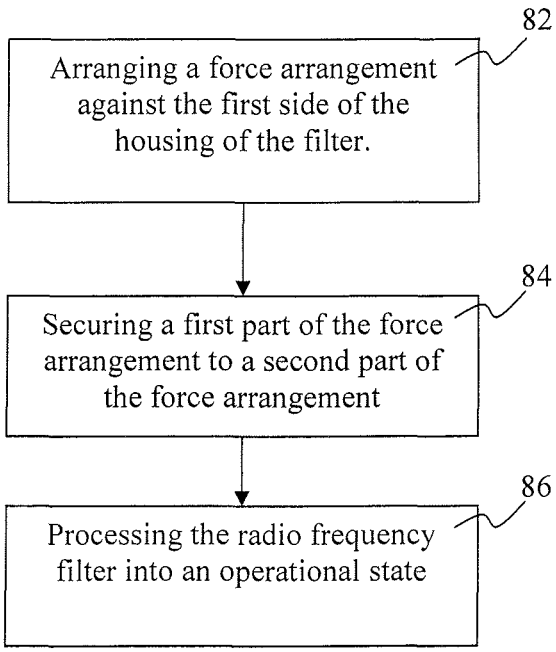
FIG. 8 shows a schematic overview of a method for assembling a radio frequency filter.

In FIG. 8, a method for assembling a radio frequency filter assembly is disclosed. The filter comprises a housing defining an inner cavity, a filter part extending along a first axis and connected to a first side of the housing being perpendicular to the first axis, the connection forming a contact seam between the filter part and the first side of the housing.

In step 82, a force arrangement is arranged against the first side of the housing, wherein the force arrangement is adapted to exert a force onto the first side in a first direction along the first axis to counteract a stress force on the contact seam generated a direction opposite the first direction along the first axis due to expansion along the first axis of the housing.

In optional step 84, a first part of the force arrangement is secured in position relative a second part of the force arrangement by, for example, snap locking the first and second part together.

In optional step 86, the radio frequency filter may be processed to an operational state, by, for example, soldering a filter part to the housing of the radio frequency filter or tuning the filter by filing down a soldered end of the filter part, or the like. The processing may be performed with the force arrangement mounted on the radio frequency filter providing forces onto the housing enhancing the contact between the filter part and the housing.

In the drawings and specification, there have been disclosed exemplary embodiments of the invention. However, many variations and modifications can be made to these embodiments without substantially departing from the principles of the present invention. Accordingly, although specific terms are employed, they are used in a generic and descriptive sense only and not for purposes of limitation, the scope of the invention being defined by the following claims.

The invention claimed is:

1. A force arrangement adapted to be mounted on a surface of a radio frequency filter, wherein the radio frequency filter comprises a housing and a filter part that extends along a first axis, wherein the filter part connects at a connection to a first side of the housing that is arranged perpendicular to the first axis, said connection forming a contact seam between the filter part and the first side of the housing, and wherein the force arrangement comprises a first spring part arranged, when mounted against the first side of the housing, to provide a first force in a first direction along the first axis that is opposite a direction of a stress force on the contact seam generated along the first axis due to expansion of the housing along the first axis, wherein the force arrangement further comprises a first part and a second part, wherein the first part comprises the first spring part and a first locking arrangement, wherein the second part comprises a second spring part and a second locking arrangement, and wherein the first and second locking arrangements are adapted to lock the first part to the second part and to thereby secure the first and second spring parts in position relative to each other.

2. A force arrangement according to claim 1, wherein the second spring part is arranged, when mounted on the radio frequency filter, to provide a second force in a second direction toward the radio frequency filter to counteract expansion of the housing in the second direction.

3. A force arrangement according to claim 2, wherein the first part and the second part are arranged facing each other, the first spring part and the second spring part, when mounted on the radio frequency filter, thereby providing forces on the housing in directions toward one other, along the first axis.

4. A force arrangement according to claim 1, wherein at least one of the first and second spring parts comprises a protruding conical shaped part.

5. A force arrangement according to claim 1, wherein the first part comprises a cavity arranged in the first spring part to provide access to the radio frequency filter for processing the filter to an operational state.

6. A force arrangement according to claim 1, wherein the first side of the housing comprises conductive metal and the filter part comprises ceramic material, and wherein the first spring part is arranged to provide the first force so as to prevent movement of the first side of the housing along the first axis relative to the filter part.

7. A force arrangement according to claim 1, wherein the force arrangement is arranged to provide the first force so as to counteract forces imposed on the contact seam when temperatures vary because of a difference in thermal expansion along the first axis between the housing and the filter part.

8. A radio frequency filter assembly comprising:

a housing that defines an inner cavity and that has a first side that is perpendicular to a first axis;

a filter part that extends along the first axis and that connects at a connection to the first side of the housing, the connection forming a contact seam between the filter part and the first side of the housing; and a force arrangement that is adapted to be mounted on a surface of the radio frequency filter assembly and that comprises a first spring part arranged, when mounted against the first side of the housing, to provide a first force in a first direction along the first axis that is opposite a direction of a stress force on the contact seam generated along the first axis due to expansion of the housing along the first axis, wherein the force arrangement further comprises a first part and a second part, wherein the first part comprises the first spring part and a first locking arrangement, wherein the second part comprises a second spring part and a second locking arrangement, and wherein the first and second locking arrangements are adapted to lock the first part to the second part and to thereby secure the first and second spring parts in position relative to each other.

9. A radio frequency filter assembly according to claim 8, wherein the assembly further comprises a plurality of force arrangements.

10. A radio frequency filter assembly according to claim 8, wherein the housing has a first thermal expansion along the first axis and the filter part has a second thermal expansion along the first axis that is lower than the first thermal expansion.

11. A radio frequency filter assembly according to claim 8, wherein the filter part comprises a rod extending along the first axis.

12. A radio frequency filter assembly according to claim 8, wherein the housing defines a cavity that has a rectangular cross section and that extends along a second axis perpendicular to the first axis.

13. A radio frequency filter assembly according to claim 8, wherein the filter part comprises ceramic material.

14. A radio frequency filter assembly according to claim 8, wherein the housing comprises metal sheet material.

15. A radio frequency filter assembly according to claim 8, wherein the second spring part is arranged, when mounted on the radio frequency filter, to provide a second force in a second direction toward the radio frequency filter to counteract expansion of the housing in the second direction.

16. A radio frequency filter assembly according to claim 15, wherein the first part and the second part are arranged facing each other, the first spring part and the second spring part, when mounted on the radio frequency filter, thereby providing the first and second forces on the housing in directions toward one other, along the first axis.

17. A radio frequency filter assembly according to claim 8, wherein at least one of the first and second spring parts comprises a protruding conical shaped part.

18. A radio frequency filter assembly according to claim 8, wherein the first part comprises a cavity arranged in the first spring part to provide access to the radio frequency filter for processing the filter to an operational state.

* * * * *